US006168032B1

(12) United States Patent
Merl

(10) Patent No.: US 6,168,032 B1
(45) Date of Patent: Jan. 2, 2001

(54) SHELF CONSTRUCTION

(76) Inventor: Milton J. Merl, 267 W. 70th St., New York, NY (US) 10023

( * ) Notice: Under 35 U.S.C. 154(b), the term of this patent shall be extended for 0 days.

(21) Appl. No.: 09/110,430

(22) Filed: Jul. 2, 1998

(51) Int. Cl.[7] ..... A47F 1/04; A47B 9/00; A47G 29/02

(52) U.S. Cl. ..... 211/59.2; 108/108; 108/147.17; 248/242

(58) Field of Search ..... 211/59.2, 153, 211/184; 248/242, 243, 247, 250, 248, 235; 108/144.11, 157.13, 147.12, 147.15, 147.17, 158.12, 6, 106, 108

(56) References Cited

U.S. PATENT DOCUMENTS

| | | | | |
|---|---|---|---|---|
| 564,005 | * | 7/1896 | Coburn | 108/147.17 X |
| 2,453,254 | * | 11/1948 | Odin | 248/242 |
| 2,730,825 | | 1/1956 | Wilds | 40/10 |
| 3,015,399 | * | 1/1962 | Radek | 211/184 X |
| 3,125,042 | * | 3/1964 | Mapson | 108/6 X |
| 3,511,193 | | 5/1970 | Schild | 108/152 |
| 3,538,860 | * | 11/1970 | Fisher | 248/242 X |
| 3,700,114 | * | 10/1972 | Myers | 248/242 X |
| 3,993,002 | | 11/1976 | Stroh | 108/108 |
| 4,314,648 | * | 2/1982 | Spamer | 211/59.2 |
| 4,346,806 | * | 8/1982 | Bustos | 211/184 X |
| 4,705,175 | * | 11/1987 | Howard et al. | 211/59.2 |
| 4,765,492 | * | 8/1988 | Howard et al. | 211/184 X |
| 5,014,861 | * | 5/1991 | Stadtler | 211/182 |
| 5,088,607 | * | 2/1992 | Risafi et al. | 211/187 X |
| 5,275,367 | * | 1/1994 | Frye | 248/250 X |
| 5,406,895 | * | 4/1995 | Suess | 211/153 X |
| 5,472,103 | | 12/1995 | Merl | 211/187 |
| 5,531,159 | | 7/1996 | Stubblefield | 108/102 |
| 5,531,336 | * | 7/1996 | Parham et al. | 211/184 X |
| 5,593,048 | * | 1/1997 | Johnson | 211/184 X |
| 5,975,318 | * | 11/1999 | Jay | 248/242 X |

* cited by examiner

*Primary Examiner*—Daniel P. Stodola
*Assistant Examiner*—Erica B. Harris
(74) *Attorney, Agent, or Firm*—Schweitzer Cornman Gross & Bondell LLP

(57) ABSTRACT

A shelf construction for use in gondola systems having spaced vertical uprights comprises a shelf floor which is removably mounted to front and rear rails. The rails are in turn supported by shelf brackets projecting from the uprights. The front and rear rails are provided with horizontal slots to accept the shelf floor and vertical slots along their lengths to accommodate shelf dividers which can be used to segregate product placed on the shelf. The shelf brackets are preferably tilted forwardly downwardly, the shelf floor having a low-friction surface to allow arrayed and displayed products to migrate towards the front edge of the shelf, making them more accessible for observation and removal.

19 Claims, 9 Drawing Sheets

18
92
20
102
24
16
16
26
100
32
102
68
22
34
3
40
34
42
38
44
28
26
52
3

FIG.3
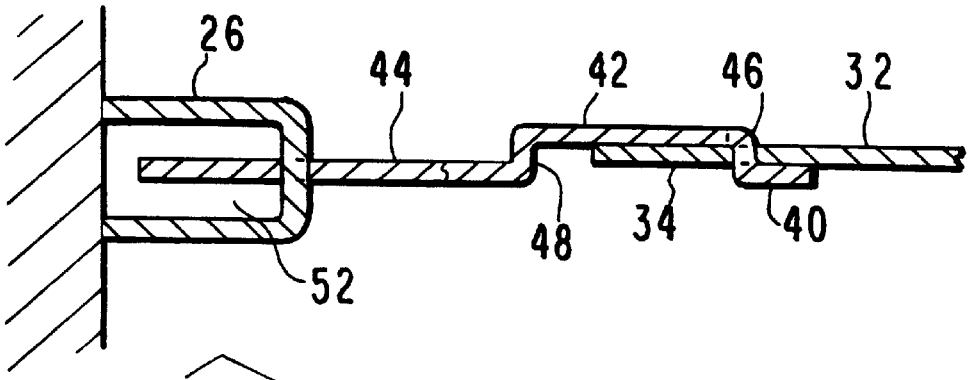
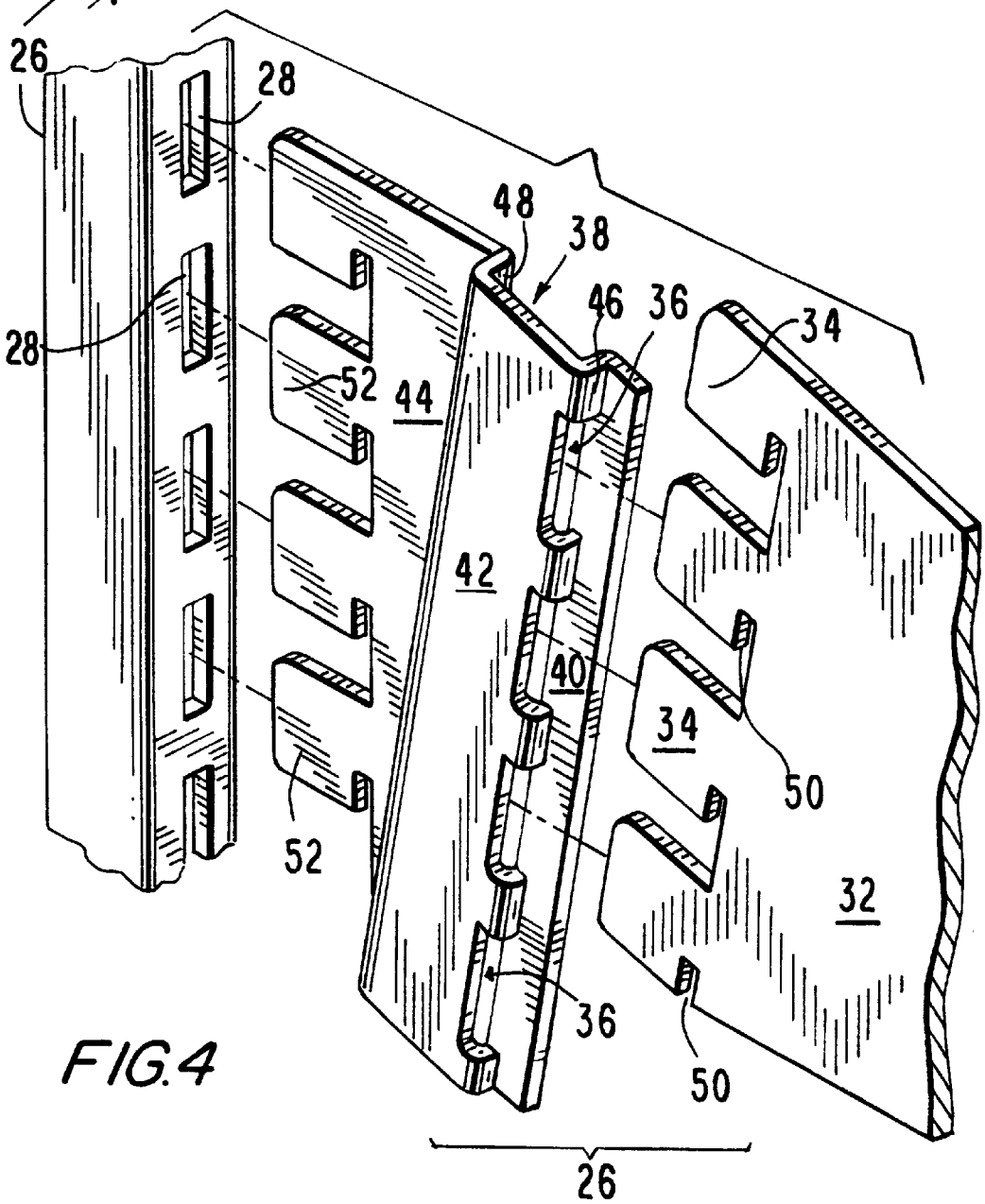
FIG.4

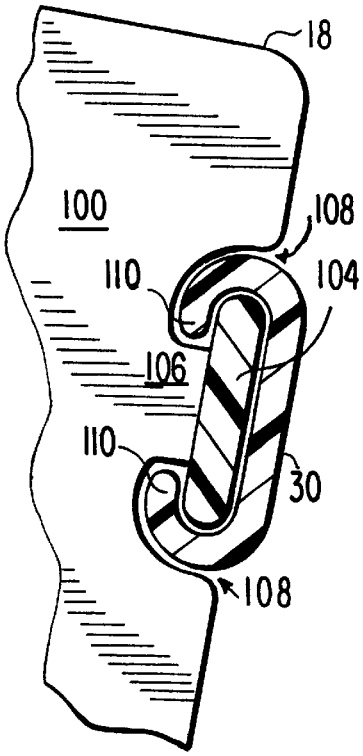
FIG.11
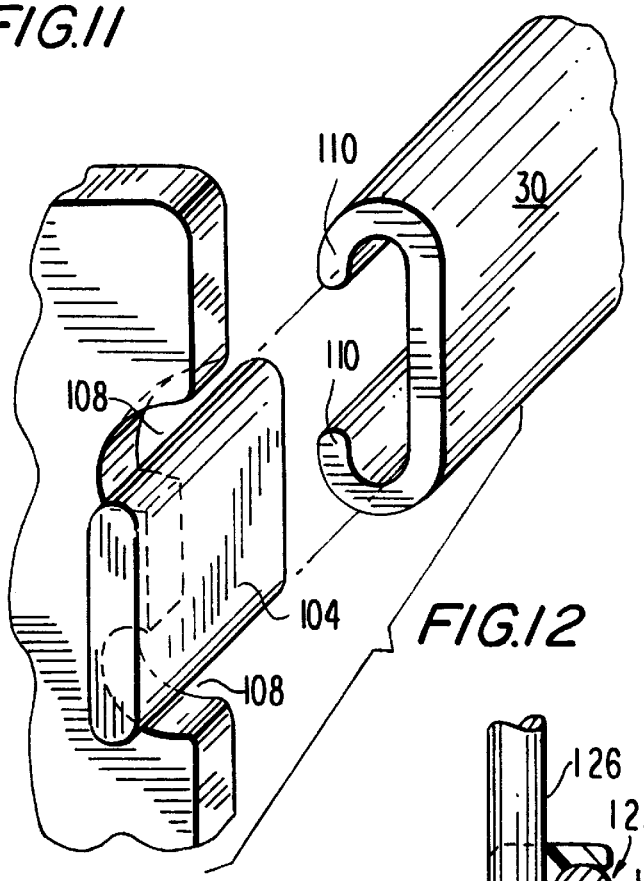
FIG.12
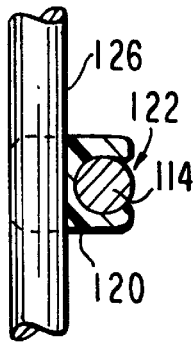
FIG. 15
FIG.14
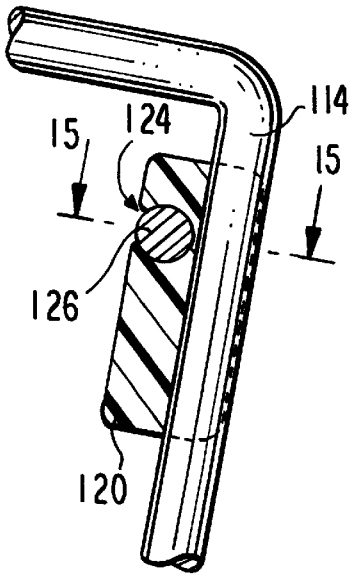
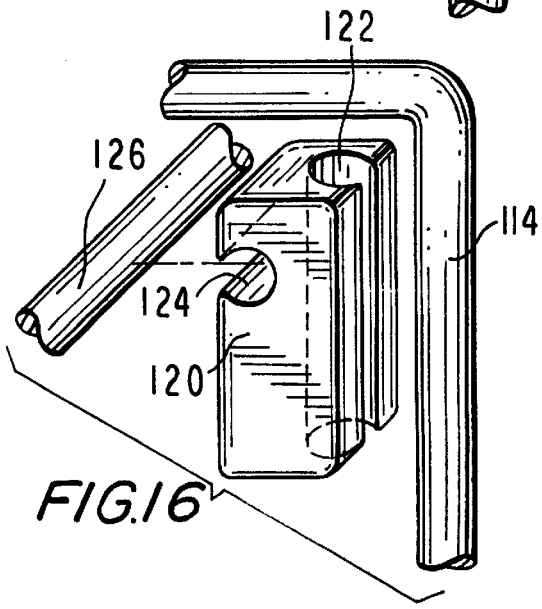
FIG.16

FIG.17
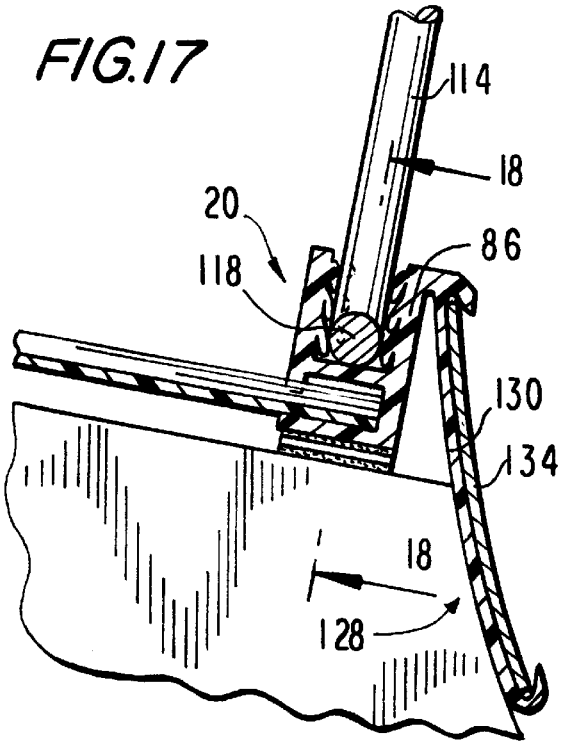
FIG.18
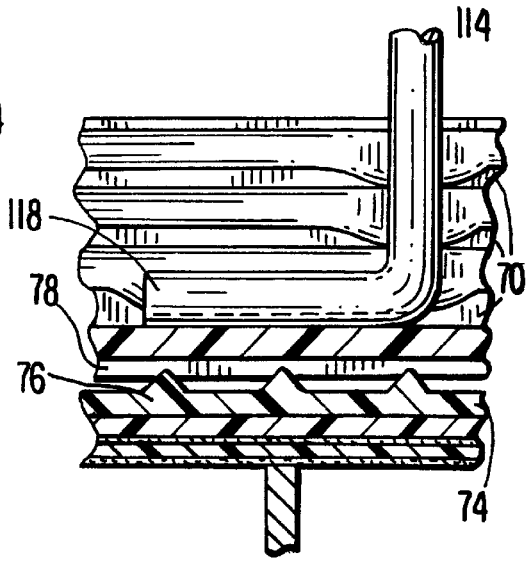
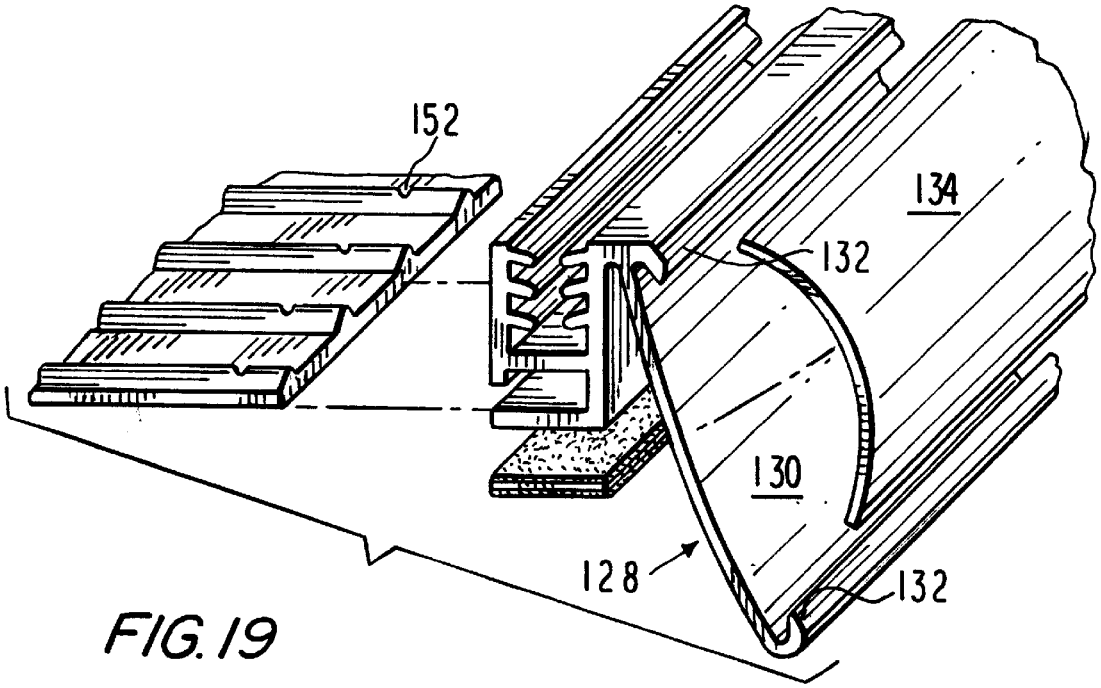
FIG.19

SHELF CONSTRUCTION

The present invention relates to a merchandising system and more particularly to an improved shelf construction for use in conjunction with conventional store shelf mounting systems.

BACKGROUND OF THE INVENTION

The majority of inventory in retail stores is displayed on forms of shelving constructions utilizing gondolas or trays for the products. The basic format of such construction has changed little over the years. A floor platform supports a vertical, upright backing board which defines a rear wall of the gondola. The gondola includes vertical uprights having a plurality of slots. The slotted uprights are adapted to support shelving and other elements in or upon which merchandise is placed for display.

The gondolas are required to display and support an ever increasing number of products in a staggering assortment of packaging in a space which is unable to expand commensurately with the demands placed upon it. Conventional gondola shelving systems often use space relatively inefficiently, and are ill equipped to handle a variety of products. The result is that there is typically insufficient gondola space available to keep and display all the desired products neatly and efficiently both for stocking purposes by store personnel and for observation and selection by customers.

While conventional shelves may be provided with premarked or segmented areas extending the depth of the shelf to divide the shelf area for multiple products, only limited flexibility in product arrangement is provided thereby. In addition, access to the rear of the shelf is often difficult, both for inventory and stocking purposes as well as for product selection by the consumer. Typically, product at the front of the shelf is removed first, making each subsequent selection and purchase more difficult, both for product accessibility as well as for product visibility on the shelf.

It is accordingly a purpose of the present invention to provide a new and improved shelf construction for the effective presentation of products in a store environment.

Another purpose of the present invention is to provide a shelf construction and system which is capable of segmentation and division to accommodate a variety of different products.

Still a further purpose of the present invention is to provide a shelf construction and system capable of maintaining products in a pleasing arrangement and urging them toward the forward end of the shelf for optimum visibility and availability.

Yet a further purpose of the present invention is to provide a shelf construction and system which is of a modular type, adaptable to a variety of shelf depths and widths, which can allow for the segmenting and separation of a plurality of different size products across the shelf, and which can be utilized in conjunction with conventional gondola constructions and shelf supports.

A still further purpose of the present invention is to provide a shelf construction and system of the aforementioned character which is of efficient and economical construction, having ease of assembly and use.

BRIEF DESCRIPTION OF THE INVENTION

In furtherance of the foregoing and other and additional objects and purposes, a shelf construction in accordance with the present invention comprises a shelf surface mountable upon a series of spaced brackets which in turn are mounted to a plurality of spaced shelf support uprights located at the rear of store gondola constructions. The shelf preferably has an upper surface formed to have a low coefficient of friction with respect to products placed thereon. The brackets upon which the shelf is placed are of an angled configuration, whereby the shelf slopes downwardly from rear to front.

Front and rear rail elements are mountable to the front and rear edges, respectively, of the shelf. Preferably the front and rear rails support the shelf upon the brackets, are in the form of extrusions, and include reception means for removable dividers which are supported by the rails and extend therebetween to divide the shelf area into a plurality of product-receiving sections. The dividers themselves extend vertically upward from the shelf surface and are positionable as desired along the length of the shelf. The dividers may further be provided with support means along their front edges, above the rails, to accept a secondary front rail which retains the stacked products therebehind and provides additional rigidity to the divider structure.

BRIEF DESCRIPTION OF THE DRAWINGS

A fuller understanding of the present invention will be accomplished upon consideration of the following detailed description of preferred, but nonetheless illustrative embodiments of the invention, when considered in conjunction with the annexed drawings, wherein:

FIG. 3 is a detail sectional view taken along line 3—3 of FIG. 2 depicting constructional details of the bracket assembly;

FIG. 4 is an exploded perspective view of the rear portion of the bracket assembly as seen in FIG. 3;

FIG. 11 is a detail elevation view of an upper portion of a divider, illustrating the connection between the divider and an upper front rail;

FIG. 12 is an exploded perspective view thereof;

FIG. 14 is a detail elevation view of the front portion of a wire divider and its interconnection with a corresponding upper front rail;

FIG. 15 is a detail section view taken along line 15—15 of FIG. 14;

FIG. 16 is an exploded perspective view of the construction shown in FIG. 14;

FIG. 17 is a detail elevation view of the interconnection between a wire divider and front rail;

FIG. 18 is a section elevation view taken along line 18—18 of FIG. 17; and FIG. 19 is an exploded view of the front portion of an alternative structure for a front rail, including integral product label display means.

DETAILED DESCRIPTION OF THE INVENTION

Figure 1:
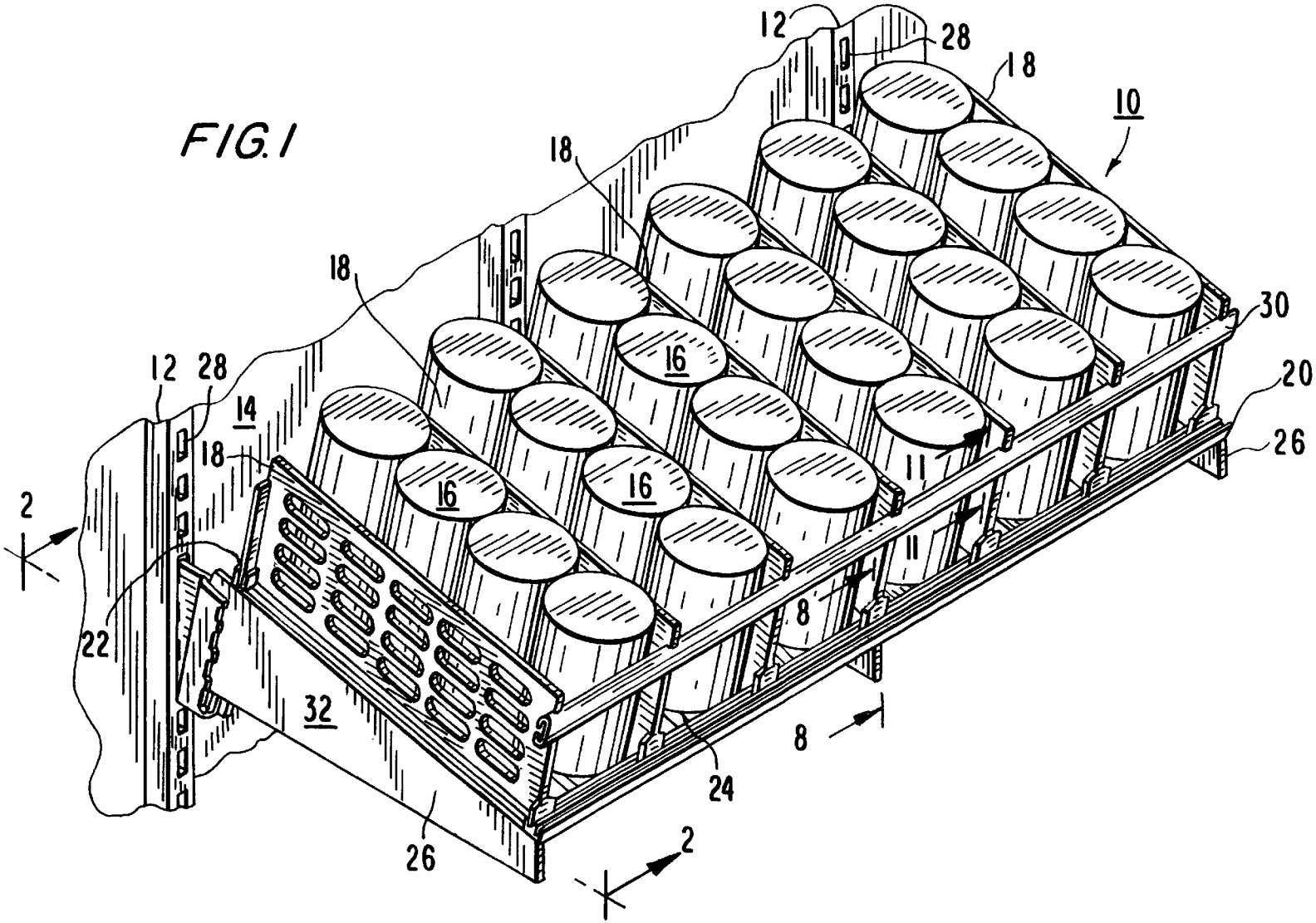
FIG. 1 is a perspective view of a shelf system of the present invention shown with products arrayed thereon.

Referring initially to FIG. 1, a shelf construction 10 of the present invention mounts to a series of spaced uprights 12 typically located at the rear wall 14 of a store display gondola construction. The shelf construction 10 allows a plurality of products 16 to be arrayed in a series of columns running from the front to the back of the shelf construction, the columns being segregated and aligned by dividers 18. The dividers extend the width of the shelf between a front rail 20 and a rear rail 22, both of which extend the length of the shelf. The front and rear rails 20, 22 support shelf floor 24, upon which the products 16 are arrayed, the rails resting upon brackets 26 which are mounted in slots 28 formed in the uprights 12. The brackets 26 are constructed and positioned such that the shelf floor slopes downwardly away from the rear wall of the gondola, whereby the arrayed products 16 are urged, under the influence of gravity, forwardly on the shelf. The products are maintained on the shelf by the front rail 20 and secondary rail 30 which is affixed to the front edges of the dividers 18.

Figure 2:
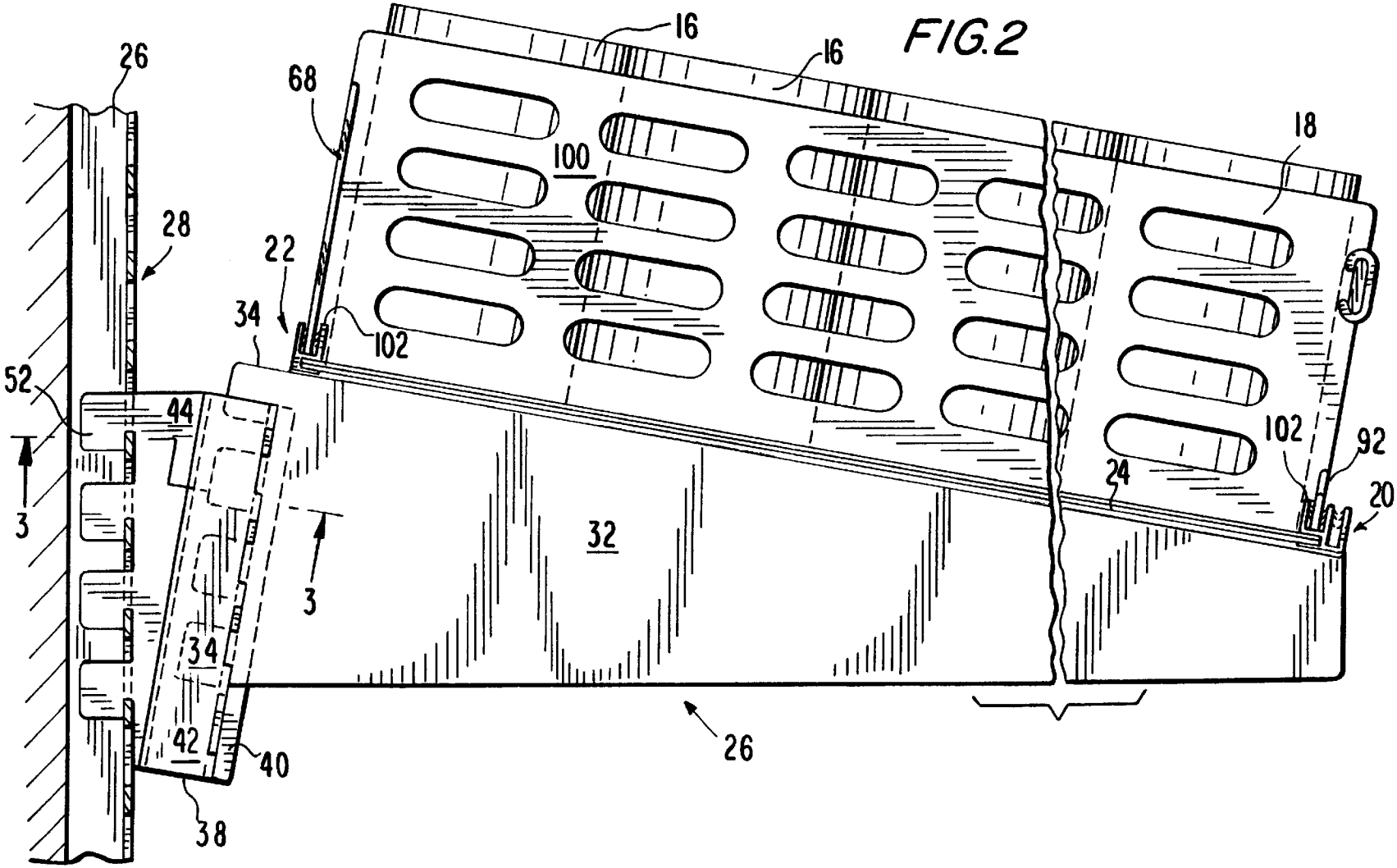
FIG. 2 is a side elevation view taken along line 2—2 in FIG. 1.

FIGS. 2, 3 and 4 illustrate the construction of the brackets 26 and the placement of the rails and shelf floor thereon. As seen therein, each bracket includes a main bracket portion 32 of elongated construction, having a flat top edge upon which the rails 20, 22 sit. The rear end of the main bracket portion 32 is provided with a series of rearwardly-extending locking tabs 34 adapted to be received by a corresponding plurality of slots 36 in transition piece 38. Transition piece 38 may be preferably of a stamped construction, having front, intermediate and rear parallel portions 40, 42, 44, respectively, joined by perpendicular portions 46 and 48. The tab-receiving slots 36 may be formed in perpendicular portion 46. The locking tabs 34 on the main bracket portions 32 each include an upwardly-extending notch 50 which, upon insertion in a slot 36, interfits with the portion 46 defining a lower edge for the slot.

The rear portion 44 of transition piece 38 has an angular lead or front edge, such that the front and intermediate portions 40, 42 of the transition piece are angled away from the vertical and that the main bracket portion extends downwardly from back to front. The offset is preferably about 15 degrees. Rear portion 44 is also provided with a set of notched locking tabs 52, similarly adapted to engage and lock with the slots 28 in the uprights 12. In a preferred embodiment, the main bracket portion 32 comprises a bracket of conventional construction, its locking tabs 34 being constructed and dimensioned for use with the uprights 12. Transition piece 38 thus serves as an adapter for the main bracket portion 32, changing its angular orientation with respect to the uprights from a right angle orientation to the angled downward position for use in connection with the present invention.

Figure 3A:
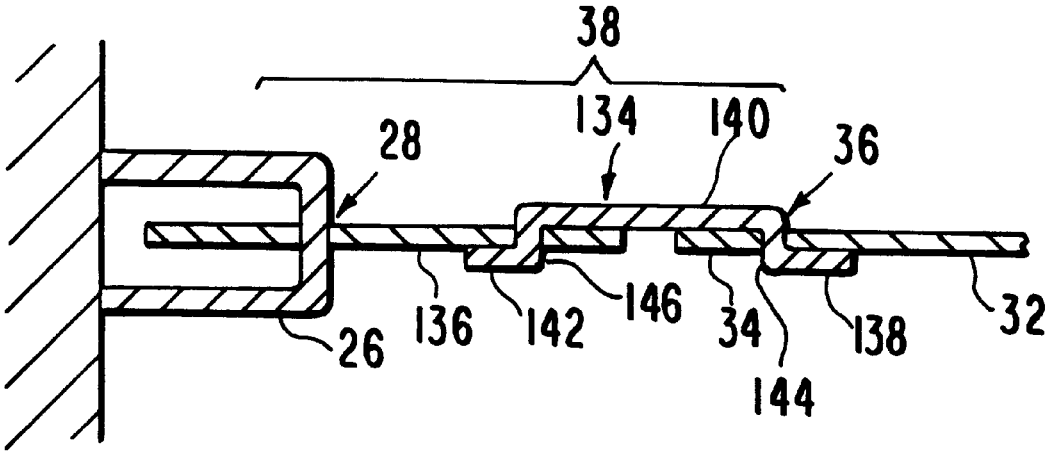
FIG. 3A is a detail sectioned view of a three-piece alternative embodiment for the bracket assembly as would be seen along line 3—3 of FIG. 2.
Figure 3B:
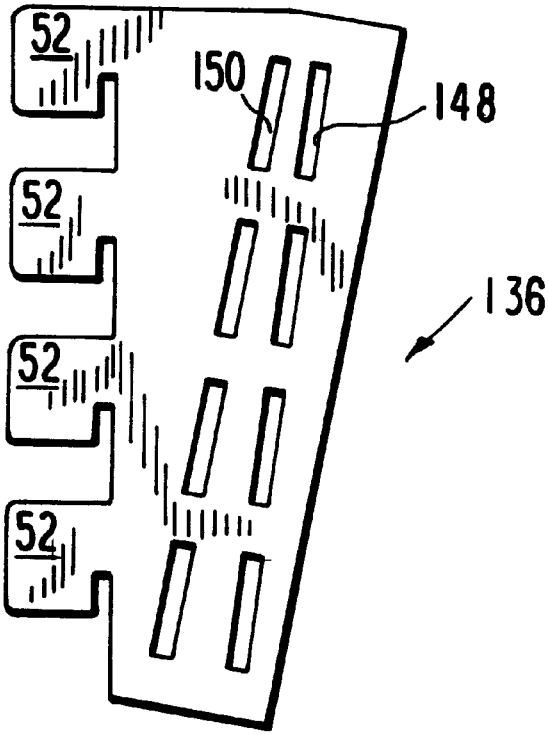
FIG. 3B is a side elevation view of the rear piece of the three-piece bracket assembly of FIG. 3A.

As depicted in FIGS. 3A and 3B, the bracket transition piece 38 may alternatively be formed of two pieces 134, 136. Piece 134 may be of stamped construction, with front, intermediate, and rear parallel portions 138, 140, 142, respectively joined by the perpendicular portions 144, 146. The front perpendicular portion 144 has slots 36 to engage the locking tabs 34 of main bracket portion 32, while the combination of rear perpendicular portion 146 and rear parallel portion 142 are notched to form a series of tabs engageable with first or second slot series 148, 150 in the other, flat transition piece 136. The alignments of slot series 148, 150 20 are offset from that of the locking tabs 52 adapted to engage the slots 28 of the uprights 12, thus providing alternative angles of slope, such as 7.5 and 15 degrees, for the main bracket portion 32 and the shelf supported thereon.

Figure 5:
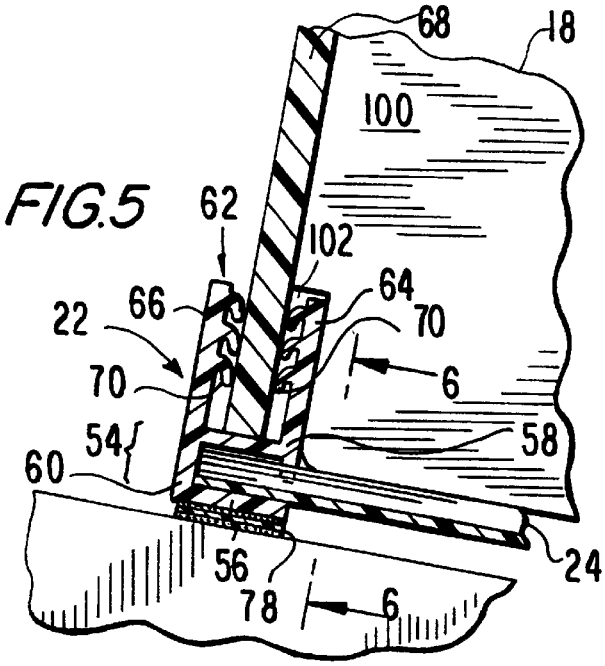
FIG. 5 is a detail elevation view of the rear portion of a shelf, presenting the rear rail and associated components.

As shown in FIG. 1, front rail 20 and rear rail 22 rest upon the top surfaces of the main bracket portions 32 of brackets 26. The construction of the rear rail 22 is set forth in FIGS. 5–7. As shown therein, the rail 22 may be preferably formed as an extrusion of an appropriate resilient material, such as a vinyl plastic composition, designed and adapted to engage and support both the shelf floor 24 and dividers 18. The rail includes a lower, floor-engaging U-shaped portion 54 with parallel, horizontal legs 56, 58. The legs 56, 58 are separated by the lower portion 60 of upwardly-extending rail rear wall 62, and are spaced apart sufficiently to accept and retain in a friction fit the shelf floor 24. The upper portion of the rail 22 comprises spaced vertical legs 64 and 66, extending upwardly from the upper leg of lower portion 54 to form a second generally U-shaped portion, the vertical leg 66 comprising the upper portion of the rail rear wall 62. The two legs 64, 66 are separated to accept and engage rear wall portions 68 of the dividers 18.

Figure 7:
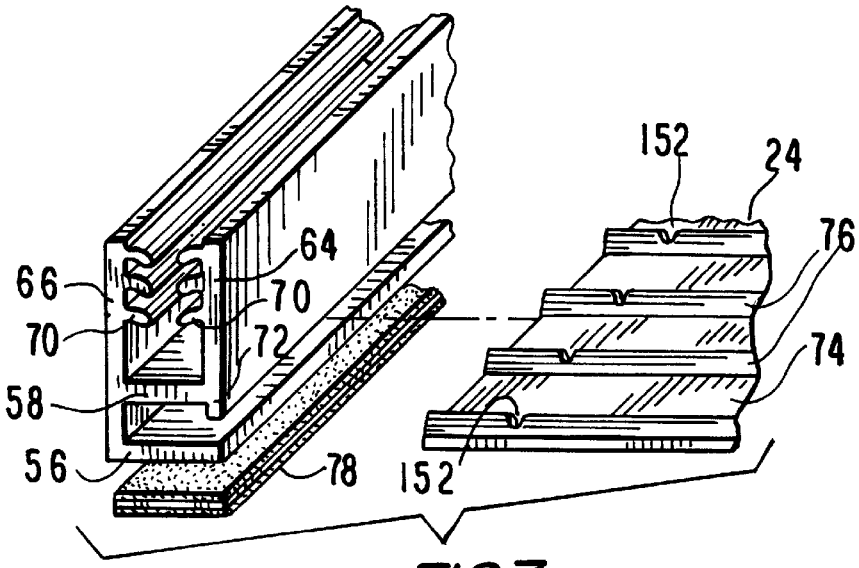
FIG. 7 is an exploded detail view of the rear portion of a shelf, including the rear rail.

The inwardly-facing surfaces of the legs 64, 66 may be provided with integral fingers 70, perhaps best seen in FIG. 7, extending along the length of the channel created by the legs, to provide a resilient, yet firm grip of the rear wall 68. The fingers may be advantageously extruded integral with the rail, but with a lower durometer value to provide additional resiliency. The lower U-shaped portion 54 of the rail may include a downwardly-directed shoulder portion 72 projecting from the upper leg 58, preferably formed as a downward extension to the vertical leg 64 of the upper U-shaped portion. The shoulder 72 provides a point contact with an upper portion of the shelf floor 24 to provide a rigid yet removable connection therebetween. The bottom surface of lower leg 56 of the rail 22 may be provided with a mounting layer 78 to permit the rail to be mounted and remain in position upon the top edges of brackets 26. Such layer may comprise, for example, a strip of two adhesive-side tape.

Figure 6:
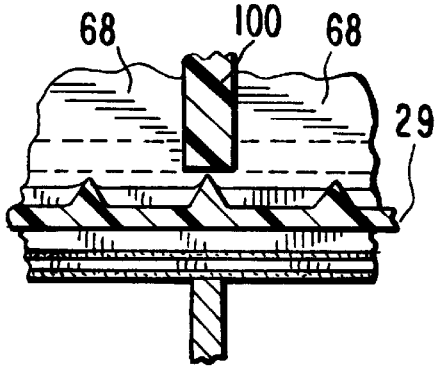
FIG. 6 is a sectional elevation view taken along line 6—6 of FIG. 5.

As perhaps best seen in FIGS. 6 and 7, the shelf floor 24 may be preferably comprised of a base plate portion 74 bearing a plurality of parallel upstanding ridges 76 extending from front-to-back and spaced along the length of the floor. The floor is preferably extruded from a high molecular weight plastic which exhibits low frictional effects upon products mounted thereon, such as a silicone impregnated styrene. The thickness of the base plate may be in the range of 0.04 inches, with the ridges 76 spaced 0.25 inch center-to-center with a height of approximately 0.06 inch. The ridges may be provided with notches 152 to engage the rail shoulder 72, providing a lock action between the rail and floor.

Figure 8:
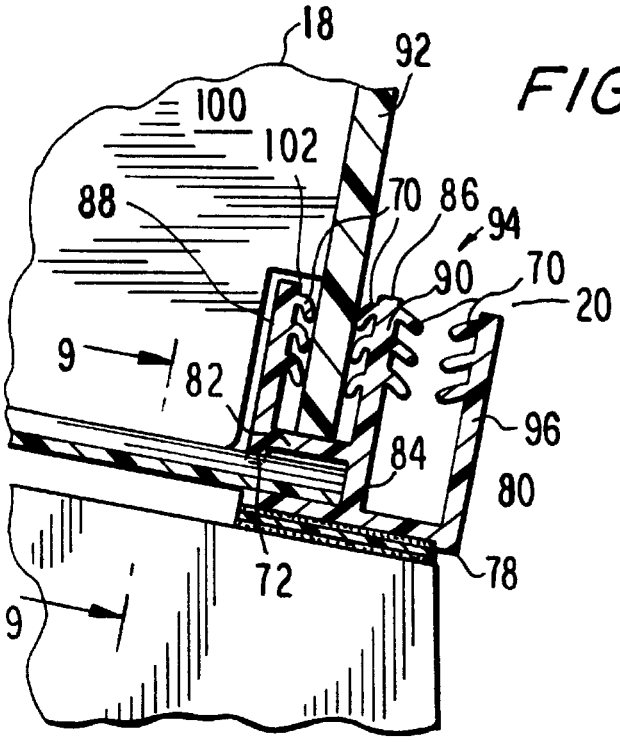
FIG. 8 is a detail elevation view of the front portion of a shelf, presenting the front rail and associated components.
Figure 9:
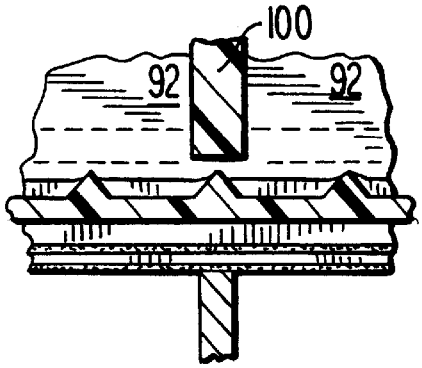
FIG. 9 is a sectional elevation view taken along line 9—9 of FIG. 8.
Figure 10:
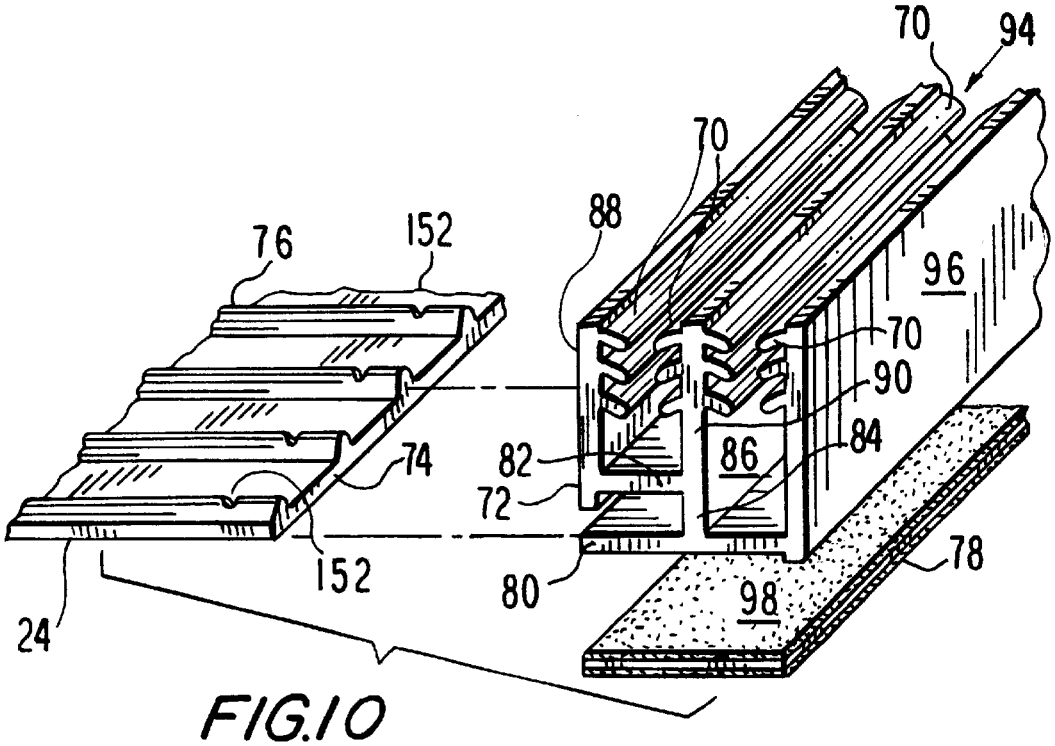
FIG. 10 is an exploded detail view of the front portion of a shelf, including the front rail.

Front rail 20, as depicted in FIGS. 8–10, is of similar construction as rear rail 22, providing support both for the shelf floor 24 and the dividers 18. The front rail 20 includes a bottom wall 80, upon the lower surface of which the mounting layer 78, such as a two-sided tape strip, is affixed. Horizontal leg 82 extends the length of the rail parallel to bottom wall 80, supported and separated therefrom by the lower portion 84 of vertical leg 86 the necessary distance to allow shelf floor 24 to be inserted into the mouth of the horizontal U-shaped portion formed thereby. Extending upwardly from horizontal leg 82 in a spaced relationship from the upper portion 90 of vertical leg 86 is rear vertical leg 88, legs 88 and 86 being separated as appropriate to accept therebetween front wall portions 92 of the dividers 18. The inwardly-directed faces of the legs 88 and 90 are provided with fingers 70 to grip the divider wall 92, while the horizontal leg 82 terminates at its rear end with the downwardly-directed shoulder 72 to engage a second series of notches in ridges 76 of shelf floor 24 located proximate the front edge of the shelf floor.

The front rail 20 may further include a second vertically-oriented U-shaped channel portion 94 whose vertical parallel walls 90 and 96 extend upwardly from the forward portion of bottom wall 80. The walls 90 and 96 are separated a distance to accept accessory items, such as flags or product indicia or information display pieces in a manner analogous to acceptance and support of the dividers 18. Towards this end, fingers 70 are provided on the opposed inner surfaces of the vertical walls. To assist in alignment and placement of the bottom layer 78 on the rail, the front vertical wall 96 may include a small depending segment or nib 98 extending below the bottom wall 80.

Referring again to FIG. 2, the dividers 18 may be formed of plastic or similar material, and comprise a main divider wall 100 with integral rear and front walls 68, 92 extending perpendicular thereto. As seen in FIG. 2, the rear wall 68 may extend upwardly for a substantial height of the divider 18, while front wall 92 is of limited height, rising only a short distance from the lower edge of the divider. The main divider wall 18 may include cut-away or notched portions 102 adjacent the lower ends of the front and rear walls to provide clearance for the front and rear rails 20, 22 when the divider is mounted thereto as detailed in FIGS. 5, 6, 8 and 9.

In order to provide increased stability and rigidity for a series of installed dividers, and to further prevent the stacked products from toppling off the shelf construction, the upper portion of the forward edge of the divider is provided with a coupling for secondary front rail 30. As seen in FIGS. 11 and 12, the front edge portion of main divider wall 100 of the divider 18 is provided with a right angle stub coupling 104 which may be integrally molded as part of the divider and which is supported by integral stem 106. The main divider wall 100 is further provided with a pair of notches 108 to provide clearance for the secondary front rail 30 about the coupling. The secondary front rail 30 may be of C-shaped cross-section, preferably formed of a PETG plastic composition, its truncated leg portions 110 surrounding and gripping the upper and lower surfaces of the stub coupling 104.

Figure 13:
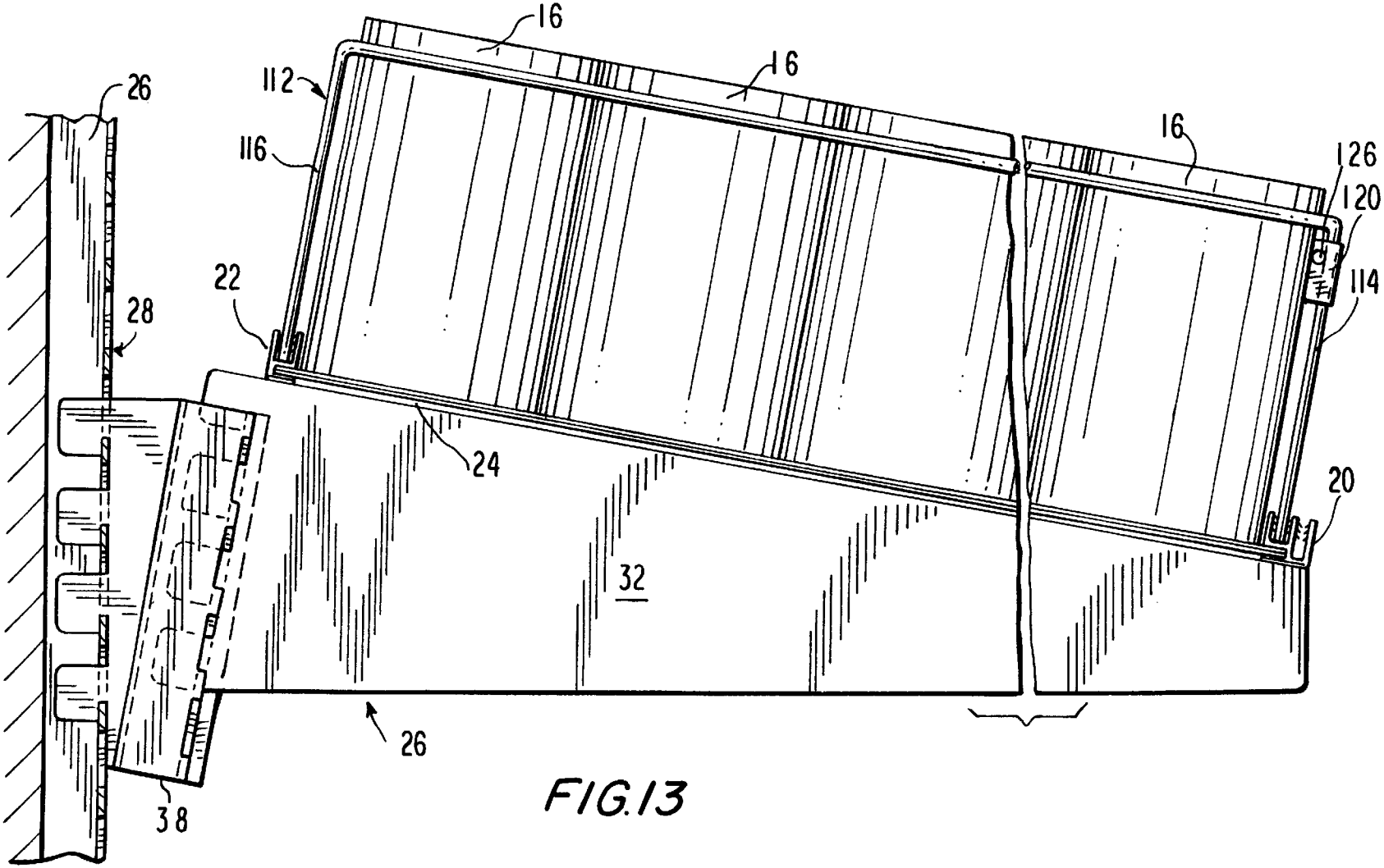
FIG. 13 is a side elevation view of an alternative embodiment of the invention, wherein the dividers are formed of wire elements.

As an alternative construction for the dividers previously discussed, the present invention contemplates the use of a formed wire divider as depicted in FIGS. 13–18. As shown therein, wire divider 112, as best seen in FIG. 13, is in the form of an inverted U fabrication, the lower ends of the front and rear legs 114, 116 engaging the corresponding slots in front and rear rails 20, 22 and being retained therein by the fingers 70. As seen in FIGS. 17 and 18, both the front and rear legs 114, 116 may be provided with a right angle foot portion 118, running perpendicular to the length of the divider, the foot portion resting at the bottom of the slot of the respective rail providing additional stability for the divider.

The wire dividers 112 may also support a secondary upper front rail, as detailed in FIGS. 14–16. As illustrated therein, a mounting block 120 is located proximate the upper end of front leg 114. The mounting block, which may be formed of an appropriate resilient plastic, includes a vertical slot 122 extending inwardly through a front face of the block and a second, horizontal slot 124 extending through a rear face of the block. Each of the slots is generally circular in cross-section, with a narrowed neck portion at the block face into which it extends to allow a wire element to be placed therein and retained by the resiliency of the block. In particular, vertical slot 122 allows mounting of the block upon the front leg 114 of the wire divider, while the horizontal slot 124 permits a front upper rail in the form of wire 126 to be inserted and supported. By proper alignment of a series of blocks 120 on successive wire dividers, the upper rail wire 126 extending the length of the shelf may be interconnected with each of the dividers, providing additional rigidity for the divider system and further providing a frontal barrier for the stacked products 16.

As further depicted in FIGS. 17 and 19, the front rail 20 may be provided with an integral product indicia mounting panel 128 in lieu of an accessory channel 94 as previously discussed. The mounting panel 128 may preferably be in the form of a flat or gently curved plate 130 extending the length of the rail 20, and joined to the top edge of forward vertical wall 86. Both the upper and lower edges of the panel 130 are provided with in-turned shoulders or hooks 132 allowing the placement of sheet 134, such as paper or cardboard, upon the panel for display purposes and its retention thereupon, as seen in FIG. 17. Typically, product identification and pricing information may be placed on the sheet, allowing the consumer, as well as store personnel, to identify the products stacked therebehind.

Utilizing conventional shelf brackets, the present invention forms a downwardly-slanting shelf unit. The shelf floor piece 24 is inserted into the appropriate reception slots in the front and rear wall elements 20, 22 and the resulting construction is placed upon the brackets 26 positioned in a spaced arrangement upon the gondola uprights 12. The rails may be affixed in place upon the brackets by the use of the double-face tape layers 78. The divider elements are then inserted within the reception slots in the front and rear rails according to the planogrammed layout for the shelf. Appropriate identification indicia may be placed in the label rail to identify the goods to be placed on the shelf. Goods placed on the shelf, supported by the point contact created by the ridges 76, are maintained in a low-friction manner, allowing the products to migrate towards the front of the shelf where they can be best seen both by store personnel for inventory and stocking purposes and by consumers for purchase.

I claim:

1. A shelf construction for use in gondola systems having spaced vertical uprights for shelf mounting, the shelf construction comprising: brackets mountable to said vertical uprights, each of said brackets having a top surface; front and rear longitudinally-extending shelf rails each having a lower surface to rest on the top surfaces of said brackets and a horizontally-extending shelf floor acceptance slot above the lower surface; a shelf floor having front and rear edges adapted for insertion into said shelf floor acceptance slots, said front and rear rails each further having a vertical shelf divider acceptance slot, and at least one shelf divider having front and rear walls engageable with said vertical shelf divider acceptance slots, said brackets each comprising a main bracket piece having the top surface upon which said rails rest and a transition piece for supporting said main bracket piece in alternative downward sloping manners, said main bracket piece and said transition piece having interconnecting means for removably joining said main bracket piece to said transition piece, said transition piece comprising a first piece mountable upon a spaced vertical upright and a second piece connecting the first piece to the main bracket, said first piece including first and second rows of slots for supporting the main bracket portion in the alternative downward sloping manners.

2. The shelf construction of claim 1, wherein said transition piece further includes means for engaging a series of slots on one of said spaced vertical uprights, said interconnecting means of said main bracket being adapted for alternative engagement with said series of slots.

3. The shelf construction of claim 1, further including means for affixing the front and rear rails to the bracket surfaces upon which they rest.

4. The shelf construction of claim 3 wherein said affixation means is two-sided adhesive tape.

5. The shelf construction of claim 1, wherein said shelf floor has a low friction surface upon which products can be placed.

6. The shelf construction of claim 5, wherein said floor includes a series of upstanding ridges extending between the front and rear edges of the shelf floor.

7. The shelf construction of claim 4, wherein said floor is constructed of a silicone impregnated styrene.

8. The shelf construction of claim 6 wherein at least one of said front and rear rails comprise means for engaging a portion of the shelf floor inserted into the rail slot.

9. The shelf construction of claim 8 wherein said engaging means comprise a projection extending from a wall of the slot.

10. The shelf construction of claim 9 wherein said upstanding ridges of the shelf floor are provided with notches located to be engaged by said projection.

11. The shelf construction of claim 1 further comprising at least one vertical divider having front and rear mounting means for engagement with said front and rear rail vertical slots.

12. The shelf construction of claim 11 wherein said front rail includes a second vertical slot for acceptance of product information indicia.

13. The shelf construction of claim 11 wherein said front rail further includes an integral product indicia mounting panel.

14. The shelf construction of claim 11 wherein said front and rear vertical slots include means for increasing a frictional contact with the mounting means of the vertical divider.

15. The shelf construction of claim 14 wherein said means for increasing frictional contact comprises a series of flexible fingers mounted upon opposed walls of the vertical slots.

16. The shelf construction of claim 11 wherein said vertical divider includes a main divider body and front and rear perpendicular walls adapted to be inserted into said front and rear rail vertical slots.

17. The shelf construction of claim 16 wherein said vertical divider is formed as an inverted U wire fabrication having front and rear legs adapted to be inserted into said front and rear rail vertical slots.

18. The shelf construction of claim 11 wherein the vertical divider further includes means for mounting a secondary front rail to a front edge of the divider.

19. The shelf construction of claim 18 further including a secondary front rail mountable to said vertical divider.

* * * * *